US012006127B1

(12) United States Patent
Davidson et al.

(10) Patent No.: US 12,006,127 B1
(45) Date of Patent: Jun. 11, 2024

(54) BOTTLE INSULATING DEVICE

(71) Applicant: Rail Holdings, LLC, Mahwah, NJ (US)

(72) Inventors: Casey Davidson, Charleston, SC (US); Nicholas W. Adler, Long Beach, CA (US)

(73) Assignee: Rail Holdings, LLC, Mahwah, NJ (US)

( * ) Notice: Subject to any disclaimer, the term of this patent is extended or adjusted under 35 U.S.C. 154(b) by 0 days.

(21) Appl. No.: 17/828,402

(22) Filed: May 31, 2022

Related U.S. Application Data

(60) Provisional application No. 63/196,359, filed on Jun. 3, 2021.

(51) Int. Cl.
*A47G 23/04* (2006.01)
*A47G 23/02* (2006.01)
*B65D 81/38* (2006.01)

(52) U.S. Cl.
CPC ..... *B65D 81/3876* (2013.01); *A47G 23/0241* (2013.01); *A47G 2023/0291* (2013.01)

(58) Field of Classification Search
CPC ..... A47G 23/0241; A47G 23/04; A47G 2023/0291; B65D 81/38766; B65D 81/38; B65D 81/3881; B65D 21/086; B65D 25/44
USPC ..... 220/739, 8, 737, 903, 592.2, 666
See application file for complete search history.

(56) References Cited

U.S. PATENT DOCUMENTS

| | | | | |
|---|---|---|---|---|
| 4,602,728 | A * | 7/1986 | Ha | B65D 25/44 222/530 |
| 9,988,202 | B2 | 6/2018 | Haas | |
| 10,173,827 | B1 * | 1/2019 | Foote, Jr. | A47G 23/0241 |
| D856,754 | S | 8/2019 | Haas | |
| D871,852 | S | 1/2020 | Haas | |
| D885,136 | S | 5/2020 | Haas | |
| D885,137 | S | 5/2020 | Haas | |
| 10,703,553 | B2 | 7/2020 | Haas | |
| D892,568 | S | 8/2020 | Haas | |
| 10,787,304 | B2 | 9/2020 | Haas | |
| D898,522 | S | 10/2020 | Haas | |
| D923,428 | S | 6/2021 | Haas | |
| 11,089,906 | B2 | 8/2021 | Haas | |
| 2016/0137331 | A1 * | 5/2016 | Hanan | B65D 11/04 215/44 |
| 2019/0144175 | A1 * | 5/2019 | Patton | B65D 50/04 215/252 |

OTHER PUBLICATIONS

U.S. Appl. No. 63/196,359, filed Jun. 3, 2021 titled Bottle Insulating Device.

* cited by examiner

*Primary Examiner* — John K Fristoe, Jr.
*Assistant Examiner* — Elizabeth J Volz
(74) *Attorney, Agent, or Firm* — Dinsmore & Shohl LLP

(57) ABSTRACT

Present embodiments relate to an insulating device. More specifically, but without limitation, present embodiments relate to an insulating device that accommodates bottles of differing size and shape by comprising an expandable boot that accommodates bottles of differing size and shape.

19 Claims, 9 Drawing Sheets

BOTTLE INSULATING DEVICE

CLAIM TO PRIORITY

This non-provisional patent application claims priority to and benefit of, under 35 U.S.C. § 119(e), U.S. Provisional Patent Application Ser. No. 63/196,359, filed Jun. 3, 2021 and titled "Bottle Insulating Device", all of which is incorporated by reference herein.

BACKGROUND

1. Field of the Invention

Present embodiments relate to an insulating device. More specifically, but without limitation, present embodiments relate to an insulating device that accommodates bottles of differing size and shape.

2. Description of the Related Art

Bottles, for non-limiting example, wine bottles, come in various shapes and sizes. It is desirable to serve certain beverages at a cold or chilled temperature and therefore necessary to keep them cold. However, accommodating bottles with differing shapes is a difficulty. Thus individual bottle insulating devices for cooling are difficult to design and manufacture.

Likewise, when a bottle is placed in an iced cooling vessel, the ice can melt resulting in the bottle becoming wet. This makes the bottle more difficult to handle and more likely to be dropped or mishandled.

The information included in this Background section of the specification, including any references cited herein and any description or discussion thereof, is included for technical reference purposes only and is not to be regarded subject matter by which the scope of the invention is to be bound.

SUMMARY

The present disclosure provides one or more of the features recited in the appended claims and/or the following features which alone or in any combination, may comprise patentable subject matter.

Present embodiments provide a bottle insulating device which may be used with bottles of varying sizes and shapes. The device includes a boot that is flexible and expandable to generally accommodate bottle necks of longer length, bottle necks of short length, and shoulders of various elevation. The insulating device allows the mouth of the bottle to extend above the boot so that the beverage may be poured without need to remove the bottle from the insulating device.

According to some embodiments, a bottle insulating device may comprise a base having a floor, a side wall extending upwardly from the floor, and an upper edge defining an inner cavity. A lower lid may have a lower portion which extends into the upper edge of the base and an upper portion of frusto-conical shape which extends from the lower portion, the upper portion having an upper edge that is open. A boot may have a frusto-conical shape including a lower edge, an upper edge, and an expandable sidewall, the expandable sidewall having an expansion band which may expand a height of the boot. The boot may expand in height to accommodate bottle necks of varying height.

In some optional embodiments, the following features and/or functions may be used alone with the bottle insulating device or in combination with other features and the bottle insulating device. The expandable sidewall may be a plurality of folds. The base may have a retaining feature. The lower lid may have a corresponding retaining feature. Each of the retaining features may be a thread. The retaining feature may be a lug. The retaining feature may be a push and twist feature. The boot may have a rim disposed at the lower edge. The bottle insulating device may further comprise a lug at the lower edge which engages a corresponding feature at the lower lid. The side wall of the base may be tapered. The side wall may have a plurality of scallops. The bottle insulating device may further comprise an insert on the floor within the inner cavity.

According to some embodiments, a bottle insulating device may comprise an expandable boot, having an upper open end of a first diameter and a lower open end of a second diameter larger than the first diameter, and an expandable sidewall having an expansion band that expands in height. A lower lid may have an upper portion which engages the expandable boot, and a lower portion which depends from the upper portion. A base may engage the lower lid, the base may have a floor, a sidewall extending upwardly from the floor, and an upper edge of the sidewall defining a cavity wherein a wine bottle may be received and, wherein the expandable boot can change in shape to accommodate wine bottles of varying sizes.

In some optional embodiments, the following features and/or functions may be used alone with the bottle insulating device or in combination with other features and the bottle insulating device. The lower lid may threadably engage the base. The expandable boot may be removably connected to the lower lid. The expansion band may be formed of a fold in a material defining the expandable boot. The expansion band may extend radially inwardly. The upper open end of the expandable boot may allow a bottle neck to pass therethrough. An inner surface of the boot may engage a shoulder of each of the wine bottles.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of a bottle insulating device will now be described by way of examples. These embodiments are not to limit the scope of the claims as other embodiments of an insulating device will become apparent to one having ordinary skill in the art upon reading the instant description. Non-limiting examples of the present embodiments are shown in figures wherein:

DETAILED DESCRIPTION

Figure 1:
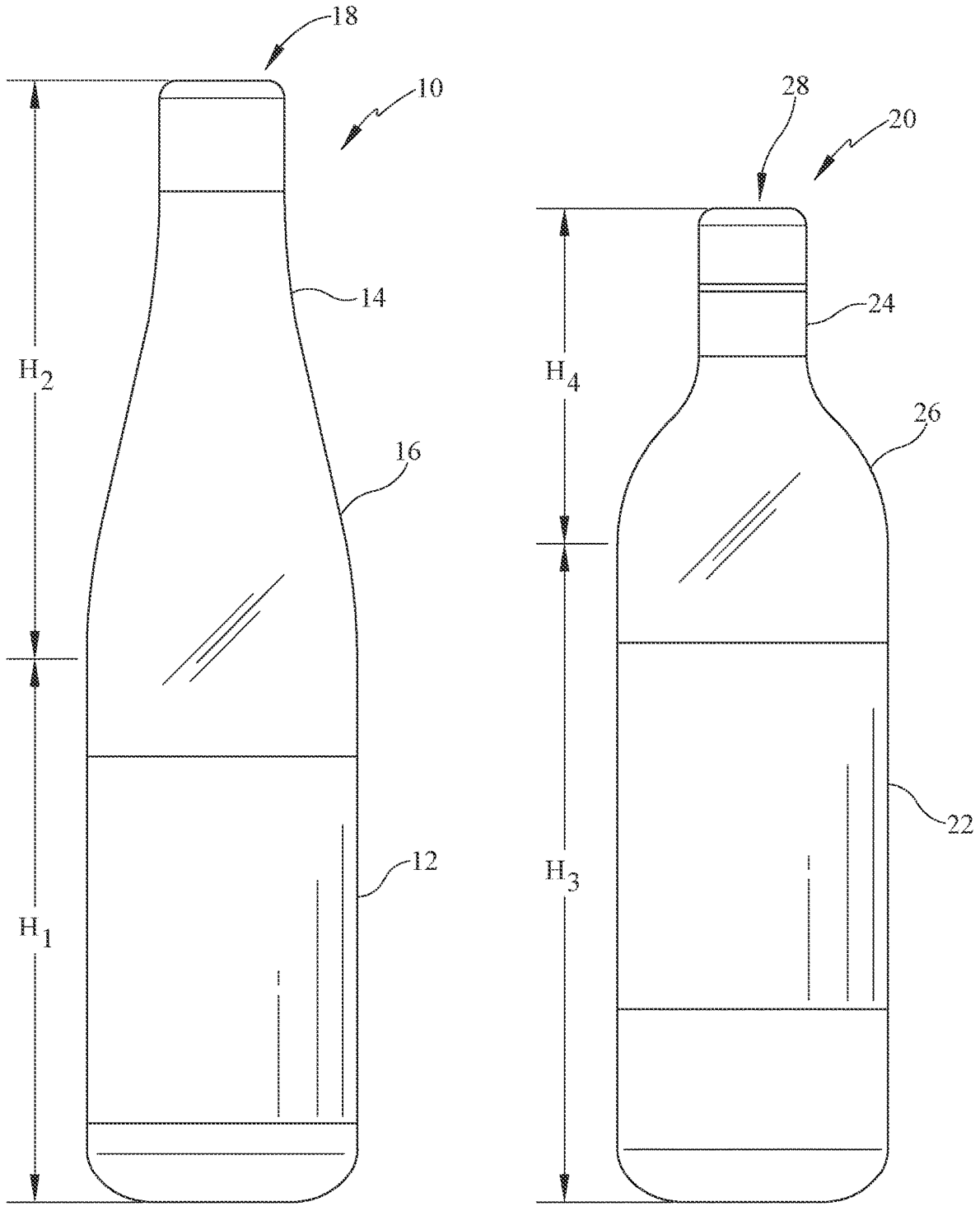
FIG. 1 is a side elevation view of two examples of non-limiting differing bottle shapes.

It is to be understood that a bottle insulating device is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Referring now to FIGS. 1-9, various embodiments of an insulating device are provided. The insulating device has a flexible and expandable boot to accommodate bottles of various size and shape. The insulating device includes a base, a lower lid, and the boot. The insulating device reduces heat transfer for bottles of various sizes allowing the beverages to remain cool or warm.

Referring now to FIG. 1, a side elevation view of two bottles. The first bottle 10 shown on the left is of a first size. The first bottle 10 comprises a body 12 of a first height $H_1$ and a neck 14 is of a second height $H_2$. The first and second heights $H_1$, $H_2$ together form the total height of the bottle 10. The neck 14 is generally defined as area where the body of the bottle 10 starts to narrow by taper or curvature to the top of the bottle. Where the body 12 tapers to the neck 14, a shoulder 16 may be defined. The shoulder 16 may vary in shape due to the gradual or more finite curvature or taper of the bottle 10.

Also shown in FIG. 1 is a second bottle 20 for comparison and as an example of alternate shapes. The second bottle 20 has a body 22 of a third height $H_3$ and a neck 24 of a fourth height $H_4$. The third and fourth heights $H_3$, $H_4$ define a total height that is different than the first bottle 10, but in other examples may be more than the first bottle 10. The two bottles 10, 20 may be the same or differ in diameter of the body and also of the neck. Additionally, the shoulder 26 of bottle 20 is more pronounced such that the shoulder 26 has a pronounced curve and while bottle 10 has a more gradual or gentle curve toward the top of the bottle 10.

The top of each bottle 10, 20 has an opening 18, 28 for pouring a beverage that may be contained in the respective bottles 10, 20. These are generally shown covered in the figures.

Additionally, Applicant notes that wine bottles may vary in size and shape characteristics based on the type of wine. For example, bordeaux, pinot noir, chardonnay, riesling, and champagne may all have distinct sizes and shapes. While bottles of wine and champagne are described, the use of these types of bottles are not limiting. Other types of bottles may be used with the insulating device 100.

Figure 2:
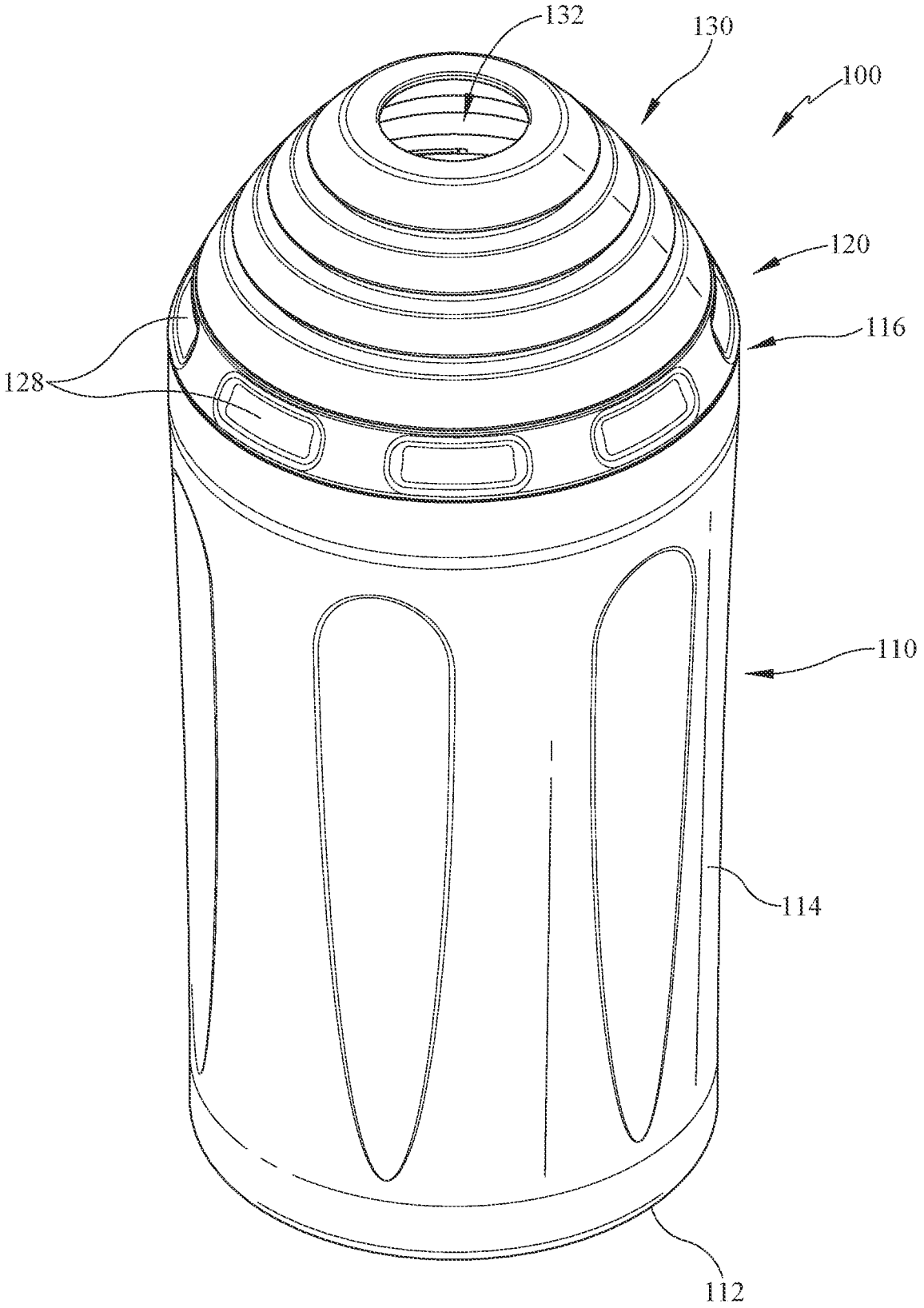
FIG. 2 is a perspective view of an insulating device.

Referring now to FIG. 2, a perspective view of the insulating device 100 is shown. The insulating device 100 may have three components, comprising a base 110, a lower lid 120, and a boot 130. The base comprises a bottom 112 and at least one external wall 114 extending upwardly from the bottom 112. The at least one external wall 114 may extend from a peripheral edge of the bottom, for example. The at least one wall may be of various shapes, and in the depicted embodiment is circular. The bottom 112 is circular, and the at least one external wall 114 is also shown as circular. The at least one wall may be cylindrical as shown or other shapes and further may or may not taper vertically. The bottom 112 and the at least one external wall 114 may have the same diameter or in other embodiments, the at least one external wall 114 may taper from a larger diameter, at the top 116, to a smaller diameter, at the bottom 112. The base 110 may be formed of a single walled structure or a double walled structure. The lower lid 120 and the boot 130 may be formed of two parts, or may be formed as a single part.

Within the base 110 is a cavity which is defined by the bottom and the at least one wall. The cavity receives the bottle 10, 20 for example.

Above the base is a lower lid 120. The lower lid 120 may have a frusto-conical shape with a lower diameter that engages the base 110 and an upper diameter that engages the boot 130. The lower lid 120 may have a plurality of grip enhancement notches 128 that aid in gripping the lower lid for rotation of the lower lid 120 relative to the base 110. The upper diameter receives the boot 130. The lower diameter is received by the base 110.

The boot 130 is also frusto-conical in shape with the upper diameter at an upper end 132 (FIG. 3) that receives a bottle neck. The boot 130 stretches or otherwise frictionally engages the outer perimeter of bottle necks and stretches upwardly when necessary to vary based on the differing shape of bottles. The opening at the upper end 132 may be sized to frictionally engage a bottle to provide seal, reducing heat transfer through the upper end 132.

Figure 3:
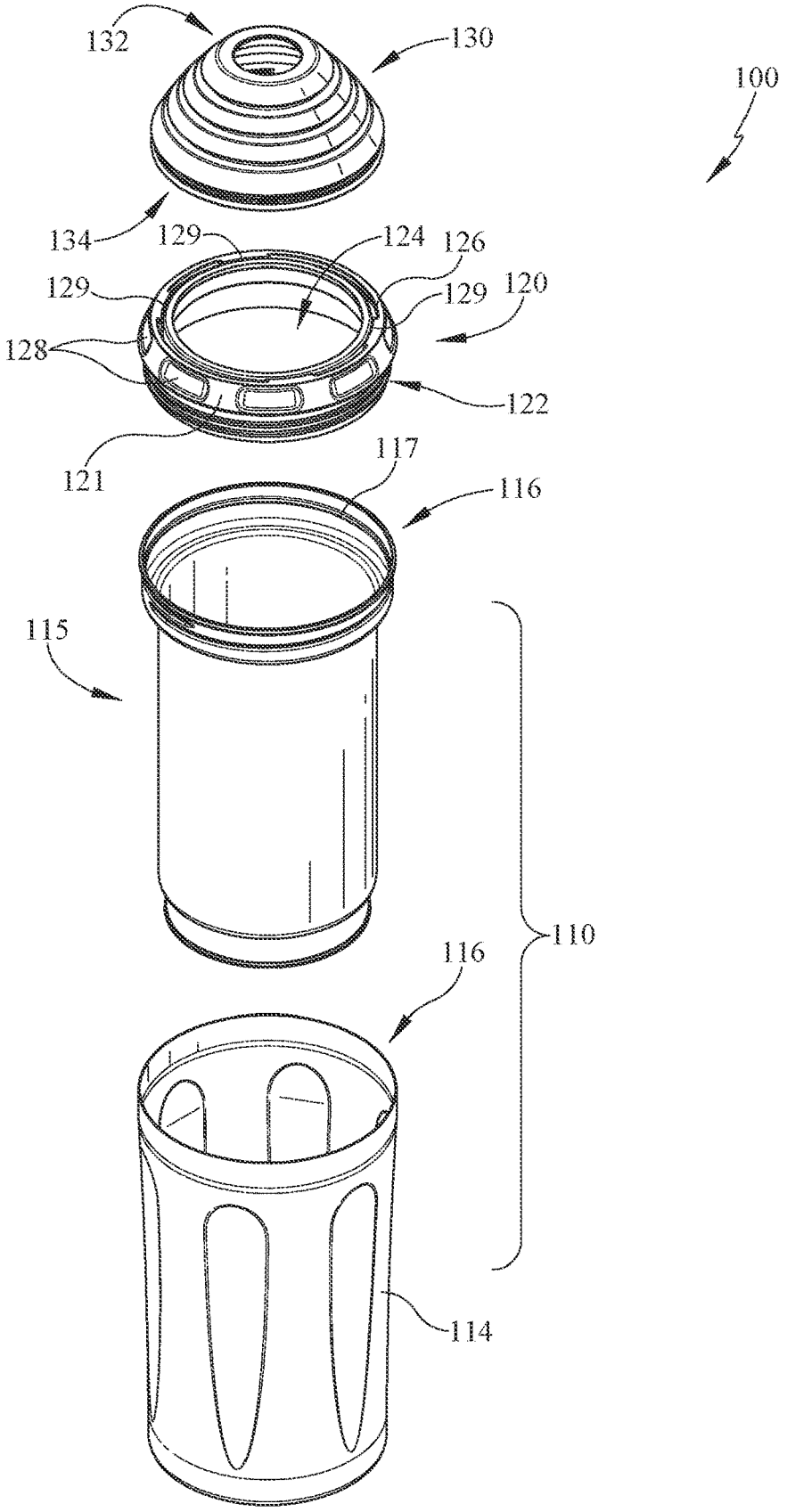
FIG. 3 is an exploded perspective view of the insulating device which accommodates bottles of differing shapes.

Referring now to FIG. 3, an exploded perspective view of the insulating device 100 is shown. The base 110 is shown having a double walled structure including the external wall 114. Above the at least one external wall 114, is an internal portion 115. The internal portion 115 may be fitted into the at least one external wall 114 and adhered with an adhesive or may be vacuum welded for example to aid in heat transfer reduction. The internal portion 115 may include threads 117 at an upper end or top 116. The threads 117 may be used to connect the lower lid 120. Other structures may be utilized to connect the lower lid to the base 110. For example, the thread 117 may be a lug or plurality of lugs in helical arrangement, or lugs which allow for push and rotate locking/unlocking for example, bayonet-style fasteners and other structures.

In other embodiments, the external wall 114 and internal portion 115 may be press fit together and may or may not further comprise an adhesive to retain the base 110 together. Additionally, the device may or may not include an insulator between the internal portion 115 and the external wall 114. In an alternative embodiment, wherein the base 110 is a single wall device, the threads 117 may be disposed on the external at least one external wall 114, on the inside surface.

Above the base 110, is the lower lid 120. The lower lid 120 is generally frusto-conical in shape, and has a lower thread 122 which engages the thread 117 of the base 110. The lower threads 122 are shown in this example disposed on a depending wall. The frusto-conical portion 121 of the lower lid 120 may have grip-enhancing features 128, for example notches, to aid in gripping and rotating the lower lid 120 relative to the base 110. The lower lid 120 has a central opening 124 through which the bottle 10, 20 for example may pass when positioned in the base 110 and extending upwardly.

Shown above the lower lid 120 is the boot 130. The boot 130 includes an upper end 132 and lower end 134, each with a respective opening. The boot 130 has a frusto-conical shape wherein the lower end 134 has a larger diameter corresponding to the upper end of the lower lid, and the upper end having a smaller diameter to allow passage of some portion of a bottle neck but engaging the neck at some location. Alternatively, the boot 130 may be curved from the smaller upper end to the larger lower end. The lower end of the boot 130 may include one or more ribs 138 (FIG. 8) that engage one or more slots in the upper end of the lower lid 120. The lower lid 120 may have fingers 129 which engage windows or slots 135 (FIG. 6) of the boot 130.

Once connected, the lower lid 120 and the boot 130 rotate together relative to the base 110. Accordingly, a bottle may be placed in the base 110 and the lower lid 120 and the boot 130 may be applied to the base 110 over the bottle neck. As the lower lid 120 and boot 130 are rotated on to the base 110, the boot 130 will frictionally engage the neck. Alternatively, the boot 130 may frictionally engage the bottle neck as it slides over the neck and before the lower lid 120 threadably engages the base 110. If the neck has a larger diameter at a higher elevation, or if the shoulder engages the boot 130, the boot 130 will stretch or expand in order to maintain connection with the lower lid 120. In alternative embodiments, the lower lid 120 may be rotatably attached to the base 110 over the bottle. Next the boot 130 may be slidably positioned over the bottle and then connected to the lower lid 120.

Figure 4:
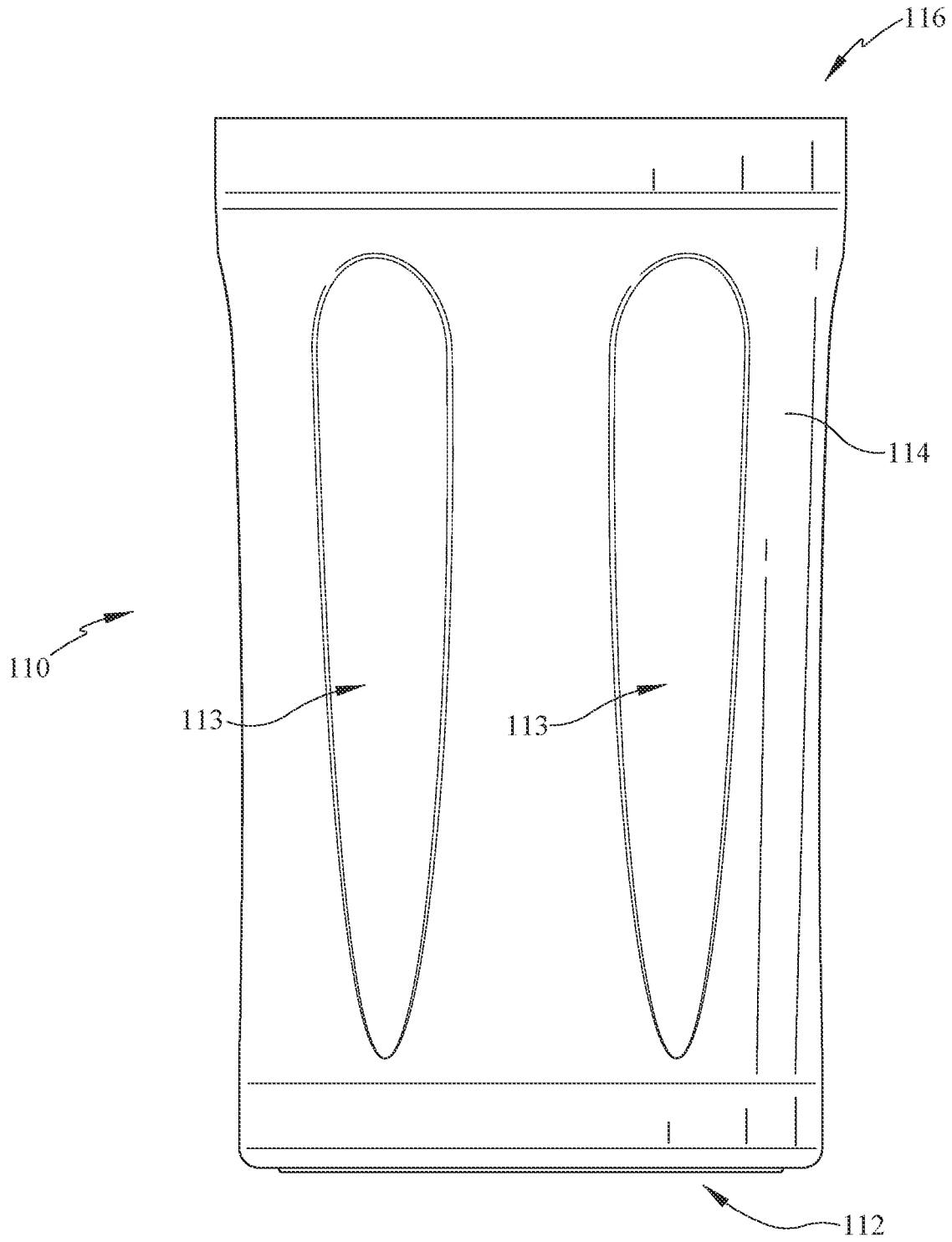
FIG. 4 is a side elevation view of the base.

Referring now to FIG. 4, the base 110 is shown having a plurality of scallops 113 in the at least one external wall 114. These may provide some aid in gripping the base 110 and when rotating the lower lid 120 relative to the base 110. Various shapes may be used in order to aid in gripping and/or provide an aesthetically pleasing shape. In the depicted embodiment, the at least one external wall 114 extends between the bottom 112 and the upper end or top 116. The at least one external wall 114 may be circular in cross-section, however it may also be that the cross-section may be square, or some other polygon. It is contemplated that the diameter may be sized to receive a commonly used bottle size, such as a wine bottle which may be desired to be chilled, or to maintain chill. The base 110 may also be sized to receive some amount of ice for example when the bottle is positioned therein.

Figure 5:
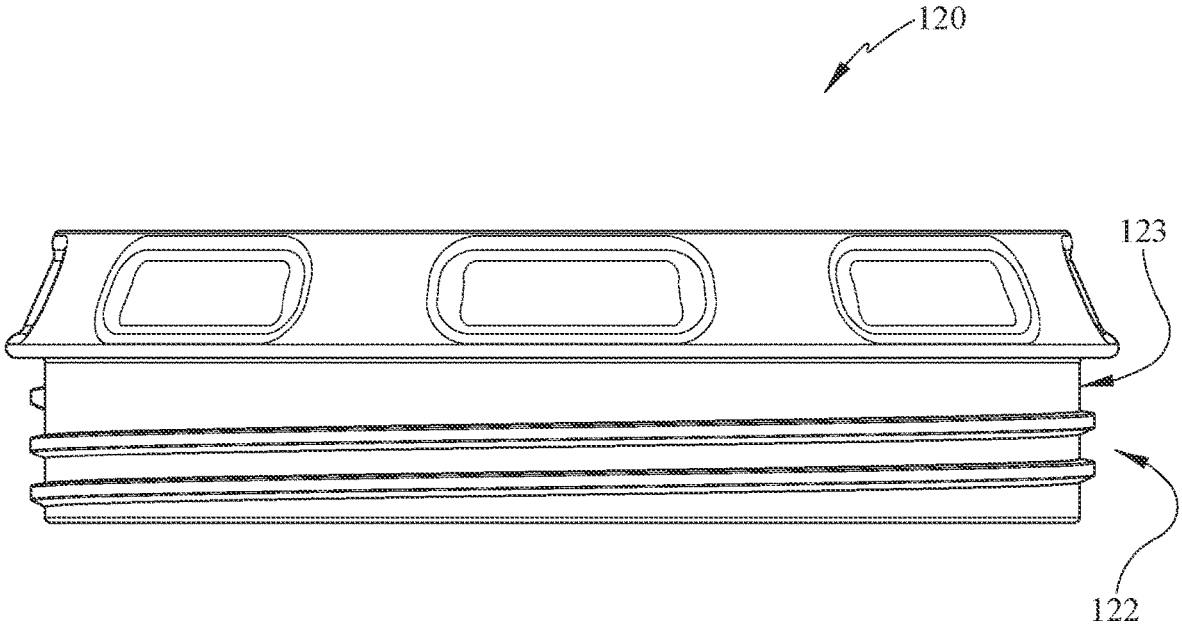
FIG. 5 is a side elevation view of the lower lid.

Referring now to FIG. 5, a side elevation view of the lower lid 120 is shown. The lower lid 120 has a depending wall including the thread 122. The thread 122 is helical for connection to the inside of the base 110. However in other embodiment, the lower lid 120 may be connected to the external surface of the base 110 or may be connected to the base 110 using other features such as locking lugs, push and turn bayonet locks, or other connecting features, which may or may not require rotation of the lower lid 120.

The upper portion of the lower lid 120 may be frusto-conical in shape tapering from the diameter of the base 110 to the upper end where the boot 130 is applied. The threads 122 may be positioned on a depending wall 123 which is cylindrical in shape and sized to fit within the base 110. Although not shown, the wall 123 may also include a sealing lip or other structure to sealingly engage the base and limit passage of fluids from within the base 110 around the outside of the lower lid 120.

Figure 6:
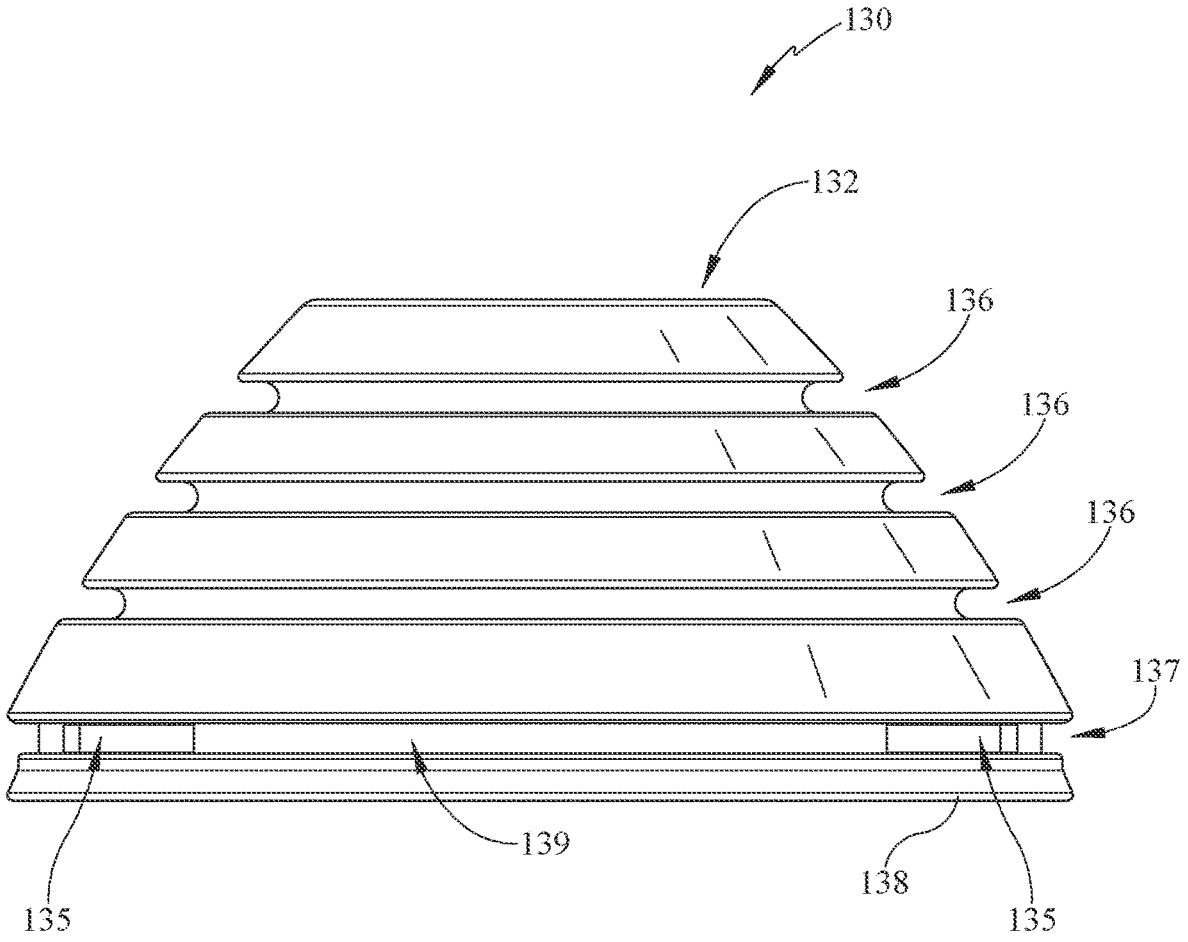
FIG. 6 is a side elevation view of the boot.

Referring now to FIG. 6, a side elevation view of the boot 130 is shown. The boot 130 has an upper end 132 and a lower end 137 defining a frusto-conical shape. A plurality of expansion bands 136 extend about the boot 130 at various elevations. The expansion bands 136 extend about the boot to allow for change in height (expansion) from the depicted to height, to a second increased height of the boot 130. The change in height may function, in some non-limiting embodiments, like an accordion. The expansion may occur depending on the diameter of the bottle neck relative to the size of the opening at the upper end of the boot 130 or if the bottle height increases, or if a shoulder of a bottle has a higher height or elevation.

At the bottom of the boot 130, is at least one rib 138 which extends around the bottom of the boot 130. The at least one rib 138 fits within at least one slot of the lower lid 120. The at least one rib 138 may have various cross-sectional shapes and as shown in one example extends radially outwardly at an angle. The lower lid 120 may include a lip or other retaining feature to retain the rib 138 in position within the lower lid 120. Various engagement features may be utilized to connect and retain the boot 130 to the lower lid 120. In some embodiments, they may be formed as a single part.

Disposed above the rib 138 is an annular recess or groove 139. The recess 139 allows for receipt of a corresponding retaining feature 127 (FIG. 7) of the lower lid 120. This keeps the boot 130 on the lower lid 120. Additionally, within the annular recess 139 is one or more slots 135 which may receive a finger or second retaining feature 129 extending from the lower lid and through the slot of the boot. These male-female features may be reversed and be within the scope of the present claims.

Figure 7:
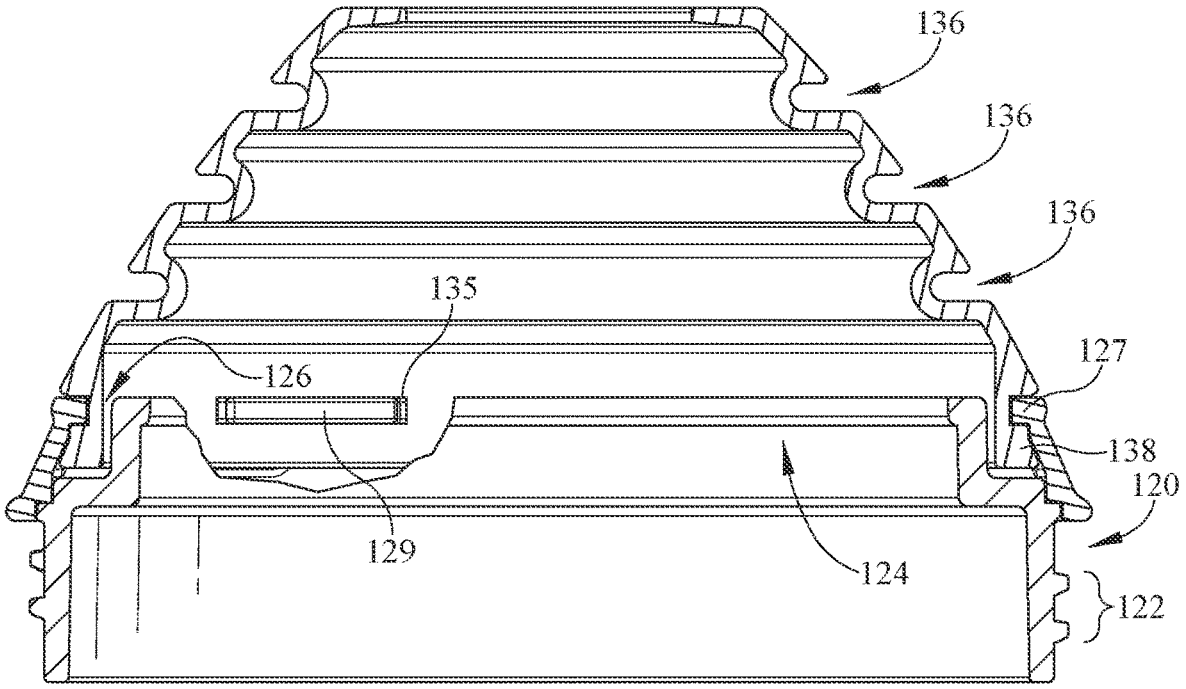
FIG. 7 is a side section view of the boot.

Referring now to FIG. 7, a sectional view of the boot 130 is shown disposed within the lower lid 120. The lower lid 120 includes a slot 126 in an upper surface wherein the at least one rib 138 may be disposed. The slot 126 may be a single slot or may be a plurality of slots so that the corresponding single or plurality of ribs 138 may fit therein. The slot 126 may also include the retaining feature 127 which serves to lock or frictionally retain the rib 138 in position.

With the lower end of the boot 130 retained, when the bottle neck engages the edge of the upper aperture of the boot 130, the boot will expand vertically if necessary during application of the boot 130 over the bottle. The expansion of the boot 130 is possible due to the plurality of expansion bands 136. The expansion bands 136 are shown as U-shaped areas extending radially inwardly from the external surface of the boot 130. Due to the frusto-conical shape of the depicted example, the expansion bands 136 also extend circumferentially around the boot 130. In an alternative embodiment, the expansion bands 136 may also extend radially outwardly from the outer surface of the boot 130. For example, the expansion bands 136 may be formed by folds in the boot 130 material, but other forms may also be used.

Figure 8:
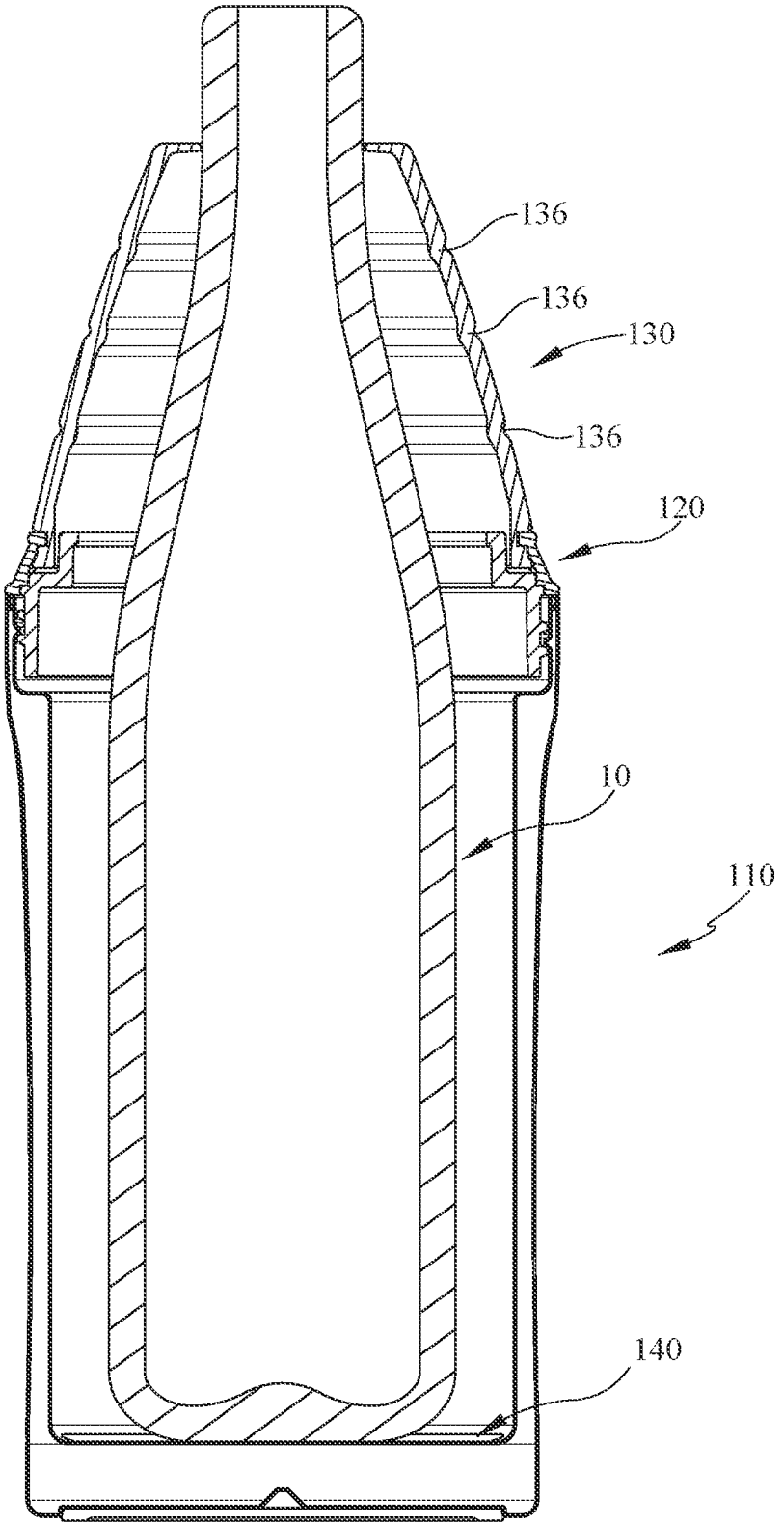
FIG. 8 is a side section elevation view of the insulating device with a bottle of a first size; and, FIG. 9 is a side section elevation view of the insulating device with a bottle of a second size.

Referring now to FIG. 8, a first section view of the insulating device 100 is shown with one bottle 10 of FIG. 1. The bottle 10 has a long neck and a diameter resulting in the stretching of the expansion bands 136 of the boot 130.

Figure 9:
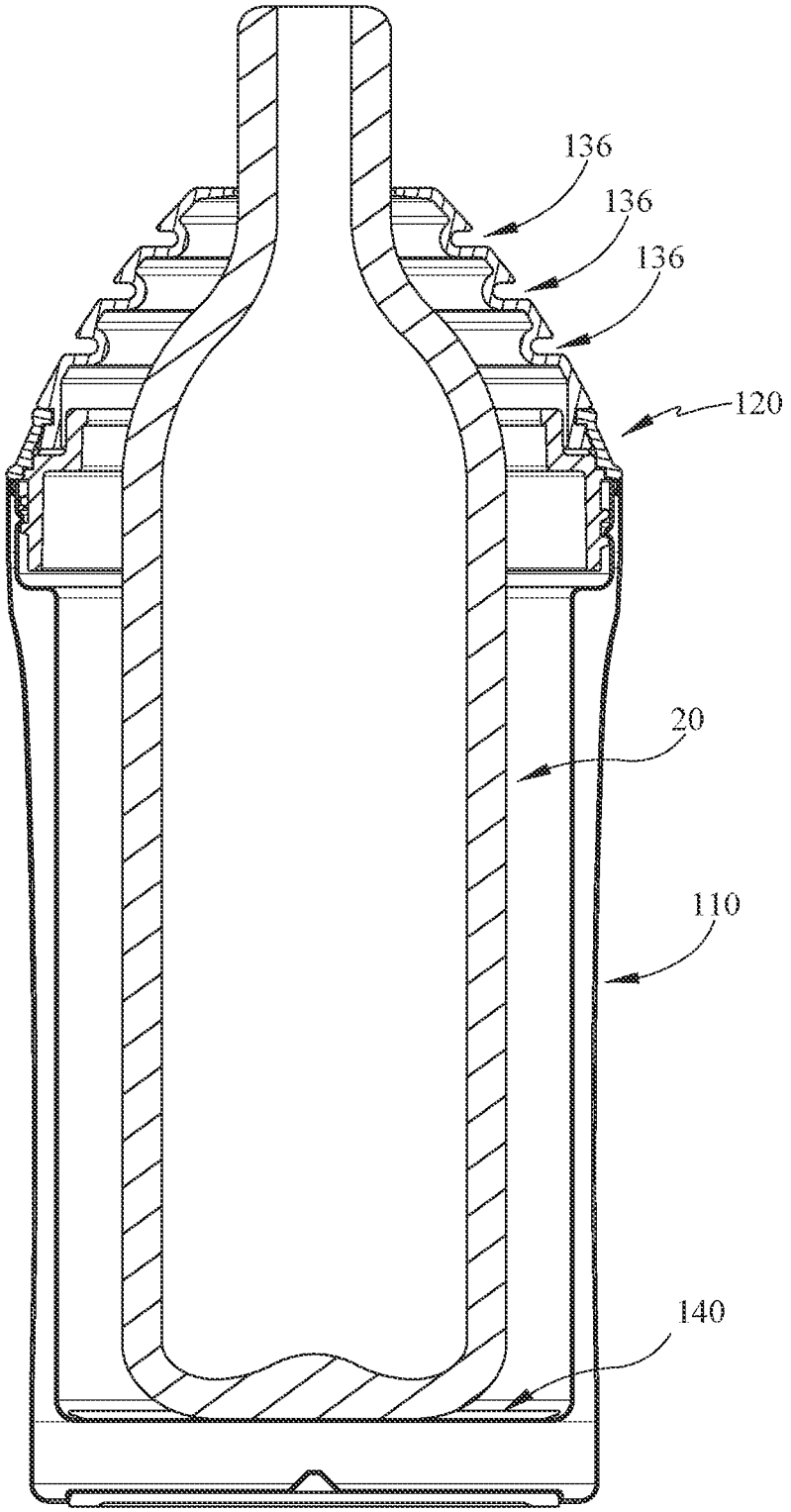

By comparison, and with reference to FIG. 9, the expansion bands 136 are not stretched by bottle 20, as indicated by the last of stretch of expansion bands 136. By comparison, if a bottle is used with a shoulder at a high elevation, this may also result in expansion of the expansion bands 136.

Referring still to FIGS. 8 and 9, an insert 140 is shown at the bottom of the inside of the base 110. The insert 140 may reduce noise of a bottle therein and may damp vibration transmitted between the base 110 and the bottle 10.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A bottle insulating device, comprising:

a base having a floor, a side wall extending upwardly from the floor, and an upper edge defining an inner cavity;

a lower lid having a lower portion which extends into said upper edge of said base and an upper portion of frusto-conical shape which extends from said lower portion, said upper portion having a slot defined by an inner wall and an outer wall;

a boot having a frusto-conical shape including a lower edge, an upper edge, and an expandable sidewall, said lower edge having a rib that is positioned in said slot between said inner wall and said outer wall, said expandable sidewall having an expansion band which may expand a height of the boot; and, wherein the boot expands in height to accommodate bottle necks of varying height.

2. The bottle insulating device of claim 1, said expandable sidewall being a plurality of folds.

3. The bottle insulating device of claim 1, said base having a retaining feature.

4. The bottle insulating device of claim 3, said lower lid having a corresponding retaining feature.

5. The bottle insulating device of claim 4, each of said retaining feature and said corresponding retaining feature being a thread.

6. The bottle insulating device of claim 4, said retaining feature and said corresponding retaining feature being a lug.

7. The bottle insulating device of claim 4, said retaining feature being a push and twist feature.

8. The bottle insulating device of claim 1, said boot having a groove disposed above said rib disposed at said lower edge.

9. The bottle insulating device of claim 8, further comprising a lug at said lower edge which engages a corresponding feature at said lower lid.

10. The bottle insulating device of claim 1, said side wall of said base being tapered.

11. The bottle insulating device of claim 10, said side wall having a plurality of scallops.

12. The bottle insulating device of claim 1, further comprising an insert on the floor within the inner cavity.

13. A bottle insulating device, comprising:

an expandable boot, having an upper open end of a first diameter and a lower open end of a second diameter larger than said first diameter, an expandable sidewall having an expansion band that expands in height, and, a rib disposed at a bottom of said expandable boot;

a lower lid having an upper portion which engages said expandable boot by receiving said rib in a slot at said upper portion, and a lower portion which depends from said upper portion;

a base which engages said lower lid, said base having a floor, a sidewall extending upwardly from said floor, and an upper edge of said sidewall defining a cavity wherein a wine bottle may be received; and, wherein said expandable boot can change in shape to accommodate wine bottles of varying sizes.

14. The bottle insulating device of claim 13, said lower lid threadably engaging said base.

15. The bottle insulating device of claim 14, said expandable boot removably connected to said lower lid.

16. The bottle insulating device of claim 13, wherein said expansion band is formed of a fold in a material defining said expandable boot.

17. The bottle insulating device of claim 16, each of said fold extending radially inwardly.

18. The bottle insulating device of claim 13, said upper open end of said expandable boot allowing a bottle neck to pass therethrough.

19. The bottle insulating device of claim 18, an inner surface of said expandable boot engaging a shoulder of each of said wine bottles.

* * * * *